US012420973B2

(12) United States Patent
Donati

(10) Patent No.: US 12,420,973 B2
(45) Date of Patent: Sep. 23, 2025

(54) DELIVERY UNIT FOR AN ASEPTIC PACKAGING MACHINE, ASEPTIC PACKAGING MACHINE AND STERILIZATION METHOD

(71) Applicant: UNIVERSAL PACK S.R.L., San Giovanni in Marignano (IT)

(72) Inventor: Pietro Donati, San Giovanni in Marignano (IT)

(73) Assignee: UNIVERSAL PACK S.R.L., San Giovanni in Marignano (IT)

( * ) Notice: Subject to any disclaimer, the term of this patent is extended or adjusted under 35 U.S.C. 154(b) by 80 days.

(21) Appl. No.: 18/018,870

(22) PCT Filed: Jul. 23, 2021

(86) PCT No.: PCT/IT2021/050226
§ 371 (c)(1),
(2) Date: Jan. 30, 2023

(87) PCT Pub. No.: WO2022/024155
PCT Pub. Date: Feb. 3, 2022

(65) Prior Publication Data

US 2023/0303283 A1 Sep. 28, 2023

(30) Foreign Application Priority Data

Jul. 28, 2020 (IT) ..... 102020000018205

(51) Int. Cl.
*B65B 55/10* (2006.01)
*B65B 9/20* (2012.01)
*B65B 51/30* (2006.01)

(52) U.S. Cl.
CPC ..... *B65B 55/103* (2013.01); *B65B 9/20* (2013.01); *B65B 51/30* (2013.01)

(58) Field of Classification Search
CPC ..... B65B 51/30; B65B 9/20–22; B65B 55/04–12; B65B 55/18–19; B31B 70/006; B31B 2155/00; B31B 2155/001
See application file for complete search history.

(56) References Cited

U.S. PATENT DOCUMENTS 2,918,770 A * 12/1959 Stocker ..... B65B 55/06 53/551
3,269,079 A * 8/1966 Schmied ..... B65B 55/06 53/551

(Continued)

FOREIGN PATENT DOCUMENTS

DE 202012002265 U1 6/2013
EP 1834878 A1 * 9/2007 ..... B65B 3/003

(Continued)

OTHER PUBLICATIONS

International Search Report and Written Opinion for PCT/IT2021/050226, mailed Oct. 15, 2021.

*Primary Examiner* — Anna K Kinsaul
*Assistant Examiner* — Mobeen Ahmed
(74) *Attorney, Agent, or Firm* — MARSHALL, GERSTEIN & BORUN LLP

(57) ABSTRACT

A delivery unit for an aseptic machine for packaging sachets starting from sterilized films includes at least one nozzle surrounded by a tubular wrapping of film. The nozzle includes a product delivery duct to deliver a product, and a sterilant delivery duct to deliver a sterilant. The delivery unit includes a deflector disposed upstream of the delivery duct directly above an upper aperture of the wrapping, and protects the aperture from external agents. The deflector interferes with the flow of the sterilant which exits from the wrapping to allow the sterilant to flow outside of the wrapping without being diluted by the external agents.

12 Claims, 3 Drawing Sheets

(56) References Cited

U.S. PATENT DOCUMENTS 3,884,012 A * 5/1975 Ernstsson ..... B65B 55/103 53/511
3,911,642 A * 10/1975 Ernstsson ..... B65B 55/06 53/167
3,912,535 A * 10/1975 Rauser ..... B65B 55/02 141/90
3,970,426 A * 7/1976 Stark ..... A61L 2/202 422/292
3,994,686 A * 11/1976 Rauser ..... B65B 55/08 426/414
4,055,035 A * 10/1977 Sjostrand ..... B65B 55/103 53/167
4,099,914 A * 7/1978 Gustafsson ..... B65B 55/103 53/167
4,109,792 A * 8/1978 Greenawalt ..... B29C 66/49 156/251
4,225,556 A * 9/1980 Lothman ..... B65B 55/103 53/425
4,524,563 A * 6/1985 Sassi ..... B65B 55/022 141/10
4,784,697 A * 11/1988 Bordini ..... B67C 3/002 53/551
5,044,140 A * 9/1991 Iwano ..... B67C 3/002 141/90
5,173,259 A * 12/1992 Bordini ..... A61L 2/20 53/167
5,335,479 A * 8/1994 Lemke ..... B65B 9/213 53/551
6,035,614 A * 3/2000 Gustafsson ..... B65B 31/045 53/551
6,804,936 B2 * 10/2004 Kurth ..... B65B 9/213 422/27
7,913,475 B2 * 3/2011 Khan ..... B65D 75/58 53/86
8,943,786 B2 * 2/2015 Konno ..... B29C 65/7451 53/511
11,097,861 B1 * 8/2021 Donati ..... B65B 51/26
11,235,898 B2 * 2/2022 Tervoort ..... B65B 9/20
11,820,540 B2 * 11/2023 Sanibondi ..... B65B 31/045
11,912,448 B2 * 2/2024 Anzaldi ..... B65B 9/12
2010/0107567 A1 * 5/2010 Khan ..... B65B 9/15 53/469
2010/0252142 A1 * 10/2010 Adriansens ..... B08B 9/0804 141/98
2016/0023789 A1 * 1/2016 Xie ..... B65B 41/16 53/550

FOREIGN PATENT DOCUMENTS

EP 3363473 A1 8/2018
EP 3643630 A1 4/2020
WO WO-2008149377 A1 * 12/2008 ..... B65B 55/103
WO WO-2017/220688 A1 12/2017

* cited by examiner

DELIVERY UNIT FOR AN ASEPTIC PACKAGING MACHINE, ASEPTIC PACKAGING MACHINE AND STERILIZATION METHOD

FIELD OF THE INVENTION

Embodiments described here concern a delivery unit for an aseptic packaging machine. The present invention also concerns an aseptic machine for packaging sachets and a corresponding sterilization method. In particular, the sachets are suitable to contain liquids such as for example oil, sauces, creams, ointments, drugs, or discrete products such as for example products in powder or granular form.

BACKGROUND OF THE INVENTION

Aseptic machines for packaging sachets are known, which generally comprise at least one delivery unit.

Generally, the delivery unit comprises at least one oblong nozzle. In such machines, the sachets are formed around the nozzle by welding one or more films of material, normally plastic, which slide around the nozzle and along its longitudinal development.

As a rule, the nozzle has at least one duct to feed the product to be packaged into the sachet, a duct to inject a sterilizing mean, and a suction duct. In particular, the nozzle has outlet holes for the product and for the sterilant and inlet holes for the suction duct. The suction duct is provided to suck the excess sterilant from inside the tube formed by the nozzle.

For example, DE202012002265 shows a nozzle to deliver a product in sachets, comprising outlet holes to feed a sterilizing liquid, outlet holes to feed hot air, located immediately downstream of the outlet holes of the liquid so as to dry the liquid, and, downstream of the hot air outlet holes, holes to suck in hot air and excess sterilizing agent. This succession of holes, during use, is located in correspondence with an upper portion of the tube of packaging film being formed around the nozzle.

EP3643630 shows a nozzle which, in addition to the tube to feed the product, the tube to feed the sterilant and the suction tube, comprises a tube to feed air that exits upstream of the aperture that delivers the product and downstream of the aperture that delivers the sterilant. Upstream of the latter there are suction apertures to suck in the excess sterilant. During use, these suction apertures are located inside the tube of packaging film.

U.S. Pat. No. 5,335,479 describes a nozzle comprising a tube to feed a product to be packaged, located internally and concentrically to a tube to feed a gas. The tube to feed the product is movable inside the gas tube and can be moved along its axis of development. In an initial start-up step of the corresponding machine, a closed tube of packaging film is created around the nozzle, and is closed transversely downstream. During this initial step, a sterilizing gas is fed into the tube, which is discharged from above. One problem with this solution is that despite the discharge from above, there is still a significant amount of excess sterilant inside the tube of packaging film. To discharge this excess, it is provided to start a production step of about twenty sachets that contain only the sterilant.

WO2017/220688 shows a nozzle comprising a central filling tube surrounded by an intermediate tube and an external tube to feed a sterilant. The tubes are disposed coaxial, and the outlet end of the external tube is upstream of the outlet end of the intermediate tube, which in turn is upstream of the outlet end of the central tube. An external duct is defined between the external tube and the intermediate tube, while an internal duct is defined between the intermediate tube and the central feed tube. During the operation of the corresponding filling machine, the sterilant is introduced into the tube of packaging film through the external duct, flows between the internal surface of the packaging film and the external surface of the intermediate tube, and is then sucked into the internal duct, which is suitably connected to a suction member.

U.S. Pat. No. 4,099,914 describes a method and an apparatus for sterilizing the inside of a tubular packaging wrapper able to contain, for example, a liquid food product. A sealing assembly is provided to heat-seal the wrapper in order to define a longitudinal bottom creasing, thanks to which the wrapper can be filled, through an upper aperture, by means of a duct to deliver the product. Another feed duct is also provided, configured to feed a sterilizing agent inside the wrapper. The apparatus also comprises an upper end screen, which substantially extends over the entire cross section of the wrapper to prevent the sterilizing agent in the form of vapor from escaping upward, compromising the action of sterilizing the inside of the wrapper. One disadvantage of this solution is that it does not allow to sterilize the outside of the wrapper as well. In fact, the presence of the upper screen is provided precisely to prevent the vapors of the sterilizing agent from escaping outside the wrapper, affecting the effectiveness of the sterilization action inside the wrapper.

One disadvantage of known delivery units is that they do not allow to take advantage of the vapors of the excess sterilant, which are simply expelled from the machine.

Another disadvantage of the state of the art is that only the internal part of the tube of packaging film is sterilized. In fact, the sterilant is introduced inside the film and is then discharged from the film before it is able to exit therefrom.

Another disadvantage is the absence of control in the diffusion of the sterilant inside the tube of packaging film. If the sterilant were not fed correctly, zones with different concentrations of sterilant could be created.

Another disadvantage is that the aspiration of the sterilizing mean can be excessive. This can lead to insufficient sterilization of the sachet being formed and also to its pollution through the aspiration of non-sterile air from the outside.

There is therefore a need to perfect a delivery unit for a machine for packaging sachets, a machine for packaging sachets and a corresponding sterilization method which can overcome at least one of the disadvantages of the state of the art.

In particular, one purpose of the present invention is to provide a delivery unit for an aseptic machine for packaging sachets which allows the controlled release of the sterilant from the tube of packaging film.

Another purpose of the present invention is to provide a delivery unit for an aseptic machine for packaging sachets which allows to make the distribution of sterilant inside the tube of packaging film uniform.

Another purpose of the present invention is to provide an aseptic machine for packaging sachets which also allows to sterilize the external surface of the tube of packaging film.

Yet another purpose is to perfect a method to package sachets in an aseptic environment which allows to sterilize the external surface of the tube of packaging film.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, there are described a delivery unit for an aseptic machine for packaging sachets, an aseptic machine for packaging sachets and a corresponding method, which overcome the limits of the state of the art and eliminate the defects present therein.

In accordance with some embodiments, there is provided a method to sterilize a tubular wrapping in an aseptic packaging machine, during its normal operation. The aseptic packaging machine preferably comprises the delivery unit as above.

The method provides to feed a film of packaging material, from which to make the sachets, around the nozzle, to form a tubular wrapping equipped with an upper aperture, to feed a sterilizing mean into the tubular wrapping, and to make the sterilizing mean flow toward the upper aperture of the tubular wrapping so as to make it exit from the tubular wrapping.

Advantageously, the method also provides, following the exit of the sterilizing mean through the upper aperture, to feed, outside the tubular wrapping, a laminar flow of gas, preferably air, along the nozzle, in the same direction of feed as the film, and outside the tubular wrapping, so as to convey the sterilizing mean along the external surface of the tubular wrapping.

Preferably, the method also provides to deflect the sterilizing means at exit from the tubular wrapping in a transverse direction with respect to the development axis of the nozzle. More preferably, this deflection is achieved by means of a deflector element disposed around the nozzle and upstream of the upper aperture of the tubular wrapping.

According to another aspect, we also propose a delivery unit for an aseptic machine for packaging sachets comprising at least one nozzle. The nozzle has an elongated shape and extends along a development axis. Around the nozzle, during use, at least one film of a material suitable to make the sachets flows longitudinally and is welded. The film that flows forms a tubular wrapping that surrounds the nozzle. The tubular wrapping is closed at its lower part downstream of the nozzle, and is open at its upper part.

In some embodiments, the nozzle comprises a product delivery duct which has an outlet end and which is configured to deliver a product to be packaged in the sachets.

In preferred embodiments, the outlet end of the product delivery duct constitutes the terminal end of the nozzle.

Furthermore, the nozzle comprises a sterilant delivery duct which has a respective outlet end and which is configured to deliver a sterilizing mean, preferably gaseous.

According to some embodiments, the nozzle also comprises a sterile delivery duct the outlet end of which is located upstream of the outlet end of the product delivery duct, and downstream of the outlet end of the sterilant delivery duct. The sterile delivery duct is configured to deliver a sterile gas under pressure, into the sachet being formed, between the sterilizing mean and the product. Advantageously, in this way, the sterilizing mean is conveyed to the outside of the sachet being formed, through its upper aperture.

According to some embodiments, the delivery unit also comprises a deflector element configured to interfere with the flow of the sterilizing mean. The deflector element is disposed upstream of the outlet end of the sterilant delivery duct. During use, the deflector element is preferably placed outside the tubular wrapping of film that surrounds the nozzle, more preferably upstream of its upper aperture. In a preferred embodiment, the deflector element is placed directly above an upper aperture of the tubular wrapping and allows to protect the upper aperture from external agents, such as a laminar flow of gas, preferably air, in order to allow the sterilizing mean to flow outside of the tubular wrapping without being diluted by such external agents.

Advantageously, the deflector element extends in a transverse direction with respect to the development axis of the nozzle. More advantageously, it extends beyond the lateral limits of the tubular wrapping.

In accordance with some embodiments, the delivery unit also comprises at least one uniforming device associated with the sterile delivery duct, and configured to make the flow of sterile gas inside the tubular wrapping uniform. In other words, the uniforming device is disposed downstream of the outlet end of the sterilizing duct and upstream of the outlet end of the product duct.

The present invention also concerns an aseptic machine for packaging sachets comprising a delivery unit as described in the present invention.

In some embodiments, the machine can comprise welding means configured to longitudinally weld one or more films of material suitable to form the sachets.

According to some embodiments of the machine, the deflector element of the delivery unit is disposed upstream of the welding means.

Advantageously, the aseptic machine comprises a pressurizer located upstream of the delivery unit, and configured to feed a laminar flow of gas, preferably air, longitudinally to the development axis of the nozzle. More advantageously, the aseptic machine also comprises a suction device disposed downstream of the delivery unit, and configured to suck in the air and convey it outside the aseptic machine.

Thanks to the delivery unit, in which the nozzles are equipped with a deflector element upstream of the tubular wrapping, the vapors of the sterilizing mean that come out of the tubular wrapping lap the outside of the tubular wrapping and move along the delivery unit, toward the suction device, by means of which the vapors, together with the laminar flow of air, are then expelled from the machine.

Thanks to the sterilizing mean, a sterile micro-environment is created in the laminar flow of air around the tubular wrapping, which also allows to sterilize the external surface of the packaging film.

ILLUSTRATION OF THE DRAWINGS

These and other aspects, characteristics and advantages of the present invention will become apparent from the following description of some embodiments, given as a non-restrictive example with reference to the attached drawings wherein.

Figure 1:
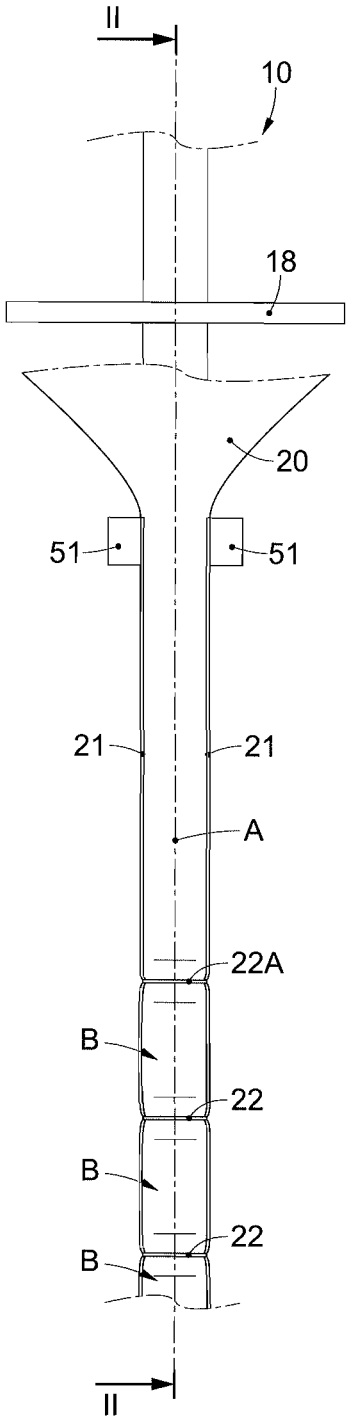
FIG. 1 is a front view of a delivery unit according to the present invention, in a condition of use.

To facilitate comprehension, the same reference numbers have been used, where possible, to identify identical common elements in the drawings. It is understood that elements and characteristics of one embodiment can conveniently be combined or incorporated into other embodiments without further clarifications.

DESCRIPTION OF SOME EMBODIMENTS

We will now refer in detail to the possible embodiments of the invention, of which one or more examples are shown in the attached drawings, by way of a non-limiting illustration. The phraseology and terminology used here is also for the purposes of providing non-limiting examples.

Referring to FIG. 1, a delivery unit 10 for an aseptic machine 50 for packaging sachets B, hereafter machine 50, comprises at least one nozzle 11.

According to some embodiments, the at least one nozzle 11 is oblong, that is, it has a longitudinal development, along a development axis A, prevalent with respect to its other sizes.

The machine 50 is able to move at least one film 20 of material able to form the sachets B around the nozzle 11, and to make it slide along the nozzle 11 in the direction of its longitudinal development by means of suitable means for feeding the film 20 (not shown). In this way, a tubular wrapping 20A is created around the nozzle 11

In some embodiments, the machine 50 has first welding means 51 (FIG. 1), configured to make longitudinal welds 21, substantially continuous, which join the sides of a film 20. Such longitudinal welds 21 can define at least one side of the different sachets B.

According to some embodiments, the machine 50 can comprise second welding means 52 which can make, downstream of the nozzle 11, transverse welds 22 which define transverse sides of the different sachets B and which seal them.

Figure 2:
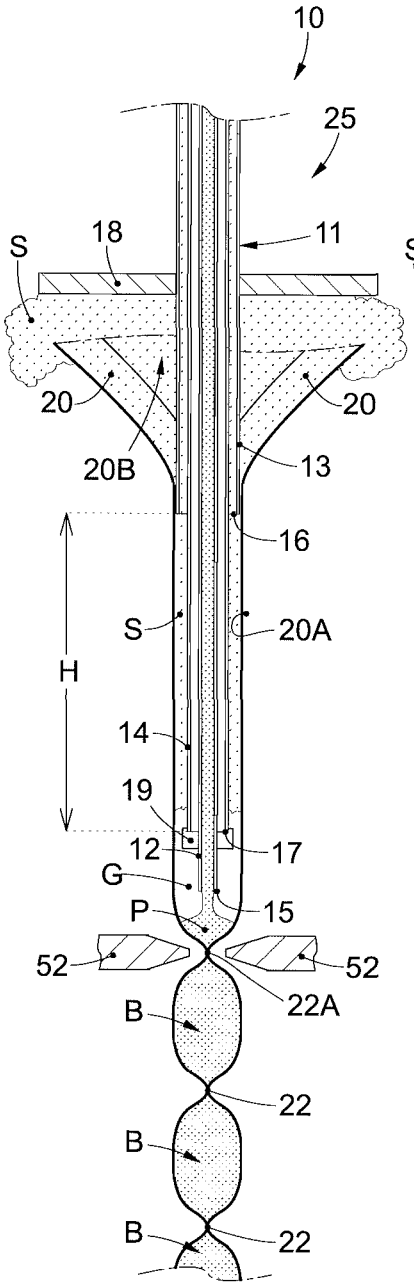
FIG. 2 is a longitudinal section view of one embodiment of a delivery unit according to the present invention, taken along plane II-II of FIG. 1.

By virtue of this, during use or during the formation of the sachet B, the nozzle 11 can be wrapped, at least partly, by the substantially tubular wrapping 20A of film 20 which slides thereon defined by longitudinal welds 21, made substantially continuously, and closed by the last transverse weld 22A made directly downstream of the nozzle 11. It is noted that the tubular wrapping 20A is open at its upper end, and therefore has an upper aperture 20B (FIGS. 2 and 3).

Figure 6:
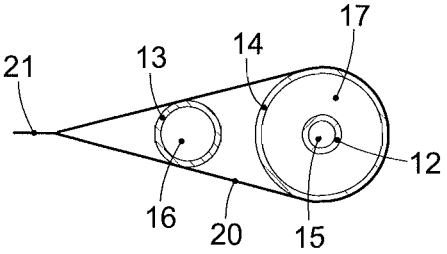
Figure 7:
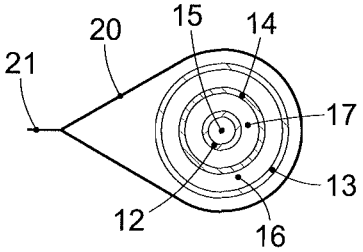

In some embodiments, the sachets B can be made with a single film 20 wrapped around itself and around the nozzle 11, during the formation of the sachet B, and welded longitudinally so as to join the two longitudinal sides thereof (FIGS. 6 and 7).

Figure 3:
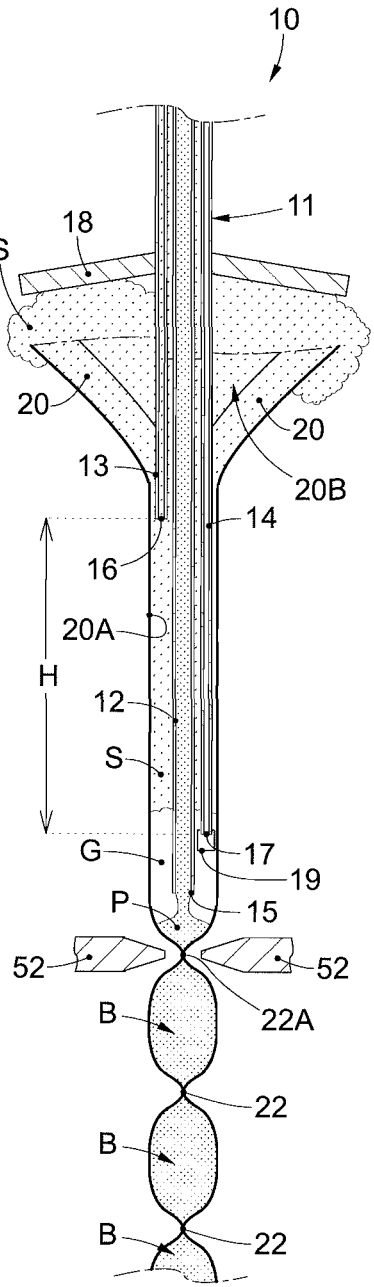
FIG. 3 is a longitudinal section view of another embodiment of a delivery unit according to the present invention.
Figure 4:
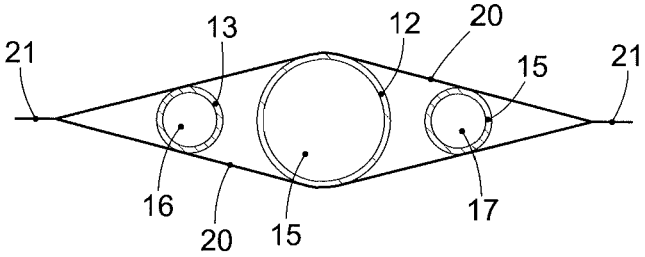
FIGS. 4, 5, 6 and 7 are schematic cross sections of a portion of different embodiments of a delivery unit according to the present invention.
Figure 5:
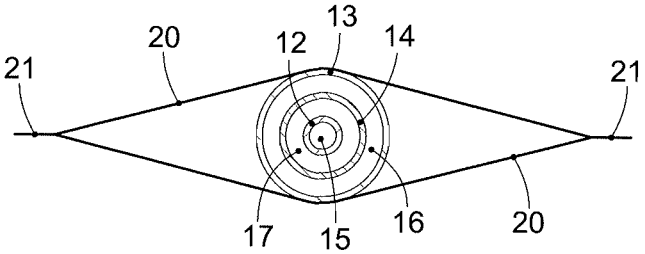

In some embodiments, the sachets B can be made with two opposite films 20 so as to contain the nozzle 11 between them, during the production of the sachet B, and welded longitudinally so as to join the longitudinal sides of one film 20 with those of the other (FIGS. 3, 4 and 5).

The film or films 20 are then welded transversely downstream of the nozzle 11, defining the other sides of the sachets B.

According to some embodiments, the feed of the film 20 around the nozzle 11 occurs continuously and the longitudinal welds 21 are made continuously in accordance with the advance of the film 20.

In some embodiments, the transverse welds 22 can be made intermittently, in accordance with the advance of the film 20 and with the desired longitudinal size of the sachets B.

According to some embodiments, the nozzle 11 comprises one or more delivery ducts 12, 13, 14. In particular, the nozzle 11 can comprise a product delivery duct 12, a sterilant delivery duct 13 and a sterile delivery duct 14.

In some embodiments, the product delivery duct 12 is configured to deliver the product P intended to be contained in the sachets B while the sterilant delivery duct 13 is configured to deliver a sterilizing mean S (FIGS. 2 and 3).

According to preferred embodiments, the sterilizing mean S is a gaseous mixture of sterilant and air. In particular, the sterilizing mean S can be a gaseous mixture of hydrogen peroxide and air. More preferably, the sterilizing mean S is a hydrogen peroxide vapor.

In preferred embodiments, the sterile delivery duct 14 is configured to deliver at least one sterile gas G, for example sterile air.

According to some embodiments, each duct 12, 13, 14 has a respective outlet end 15, 16, 17 disposed along the nozzle 11.

According to one aspect of the invention, during use, each outlet end 15, 16, 17 comprised in the nozzle 11 can be inside the wrapper 20A of film 20 which slides along the nozzle 11, the wrapper 20A being defined by longitudinal welds 21 and by the last transverse weld 22A made directly downstream of the nozzle 11.

In preferred embodiments, the outlet end 15 of the product delivery duct 12 coincides with the terminal end of the nozzle 11.

According to some embodiments, the outlet end 16 of the sterilant delivery duct 13 can be disposed upstream of the outlet end 15 of the product delivery duct 12.

Advantageously, in this way, the film 20 with which the sachets B are made, which slides along the nozzle 11, comes into contact with the sterilizing mean S before coming into contact with the product P. By virtue of this, packaging sachets B the interior of which has not been sterilized is prevented.

According to one aspect of the invention, the outlet end 17 of the sterile delivery duct 14 can be positioned, along the longitudinal development of the nozzle 11, between that of the product delivery duct 12 and that of the sterilant delivery duct 13. In particular, the outlet end 17 of the sterile delivery duct 14 can be positioned upstream of that of the product delivery duct 12 and downstream of that of the sterilant delivery duct 13.

Advantageously, in this way, sterile gas G is delivered between the outlet end 15 of the product delivery duct 12 and the outlet end 16 of the sterilant delivery duct 13. By virtue of this, a volume of sterile gas G is created between the sterilizing mean S and the delivery zone of the product P, which prevents the trapping of sterilizing mean S in the sachet B (FIGS. 2, 3 and 8).

In some embodiments, the sterile gas G is delivered at a pressure higher than atmospheric pressure.

In other embodiments, the sterilizing mean S is also delivered at a pressure higher than atmospheric pressure.

Figure 8:
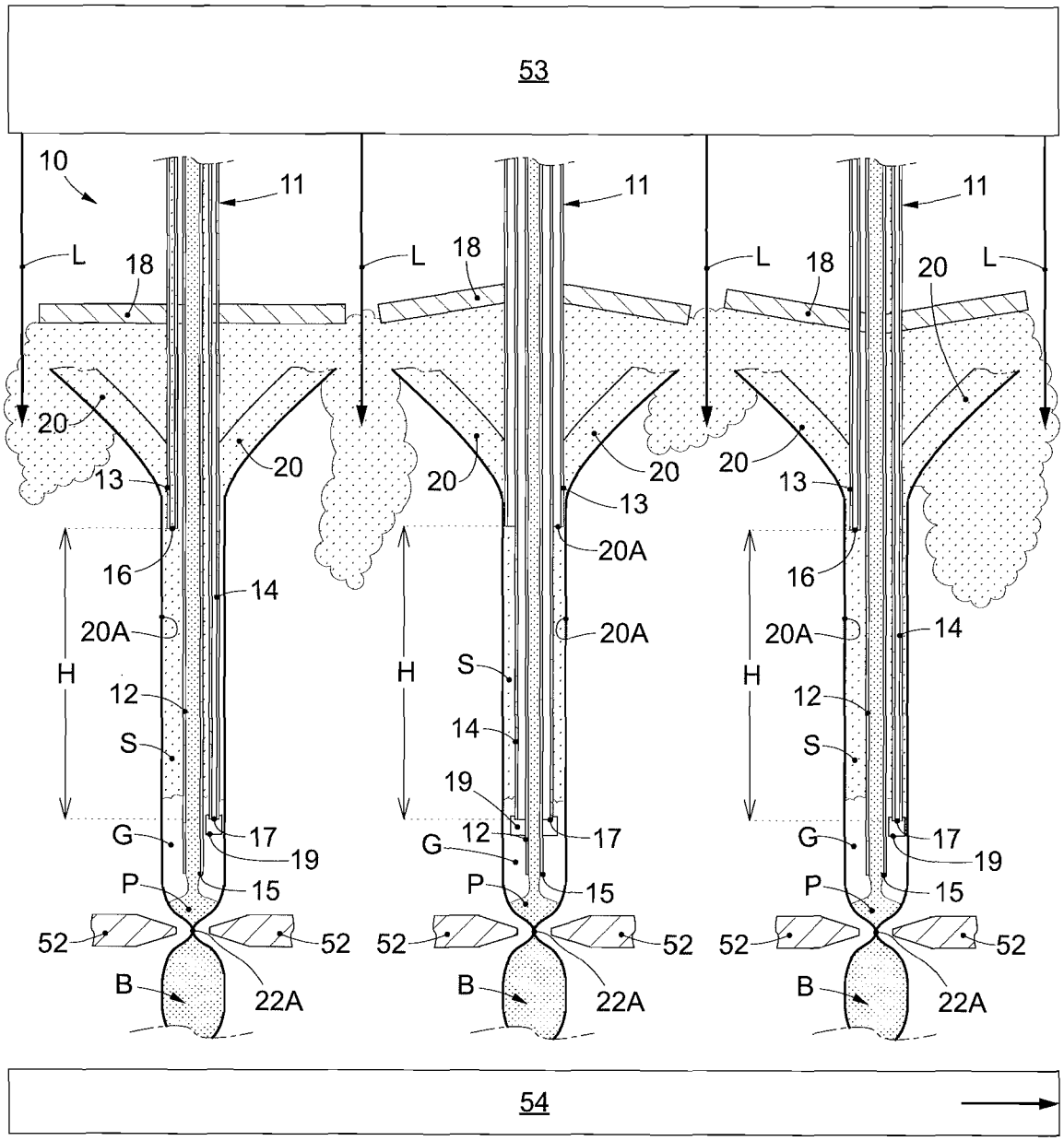
FIG. 8 is a schematic view of an aseptic machine comprising another embodiment of a delivery unit according to the present invention, shown in longitudinal section.

In the example shown, the outlet end 16 of the sterilant delivery duct 13 and the outlet end 17 of the sterile delivery duct 14 are distant from each other by a distance H along the nozzle 11 (FIGS. 1, 2 and 8).

A person of skill in the art will easily understand that the distance H and the longitudinal feeding speed of the film 20 are sized so as to guarantee a meeting time between the sterilizing mean S and the film 20 which allows a complete sterilization thereof, at least of its surface located inside the wrapper 20A, which will come into contact with the product P to be packaged.

In an alternative embodiment, not shown in the drawings, in which the three ducts 13, 14, 15 are coaxial, the sterilant delivery duct 13 is equipped with radial delivery means, for example through holes, along a delivery zone of the duct itself around which there is created a zone filled with the sterilizing mean S. In this case, the length H can be the length of the delivery zone, taken longitudinally to the sterilant delivery duct 13, in which the radial delivery means are disposed.

According to some embodiments, the ducts 12, 13, 14 of the nozzle 11 can be concentric. In particular, with reference to FIGS. 2, 5 and 7, in one embodiment the sterilant delivery duct 13 can partly contain the sterile delivery duct 14 which in turn can partly contain the product delivery duct 12.

According to preferred embodiments, the ducts 12, 13, 14 of the nozzle 11 are disposed side by side and parallel (FIGS. 1 and 4). This conformation allows to speed up the cleaning operations of the machine 50.

In other embodiments, two ducts of the nozzle 11 can be disposed concentric and a third can be disposed side by side and parallel to them. One example of this embodiment is shown in FIG. 6, in which the sterilant delivery duct 13 is separated from and parallel to the product delivery duct 12 and the sterile delivery duct 14, which are instead concentric.

In accordance with some embodiments, the delivery unit 10 also comprises a deflector element 18 associated with the nozzle 11 upstream of the outlet end 16 of the sterilant delivery duct 13 (FIGS. 2 and 3).

The deflector element 18, advantageously disposed directly above the upper aperture 20B of the tubular wrapping 20A, allows to protect the upper aperture 20B from external elements, such as for example a laminar flow L of air, so as to allow the sterilizing mean S to flow out of the tubular wrapping 20A without being diluted. In addition, the deflector element 18 participates in deflecting the vapor of the sterilizing mean transversely to the development axis A, around the upper aperture 20B.

Obviously, if the delivery unit 10 comprises a plurality of nozzles 11, each of these is advantageously equipped with a respective deflector element 18 (FIG. 8).

Preferably, the deflector element 18 has a flat body and is disposed perpendicular to the development axis A (FIG. 2). However, it is possible to provide a deflector element 18 with a substantially truncated cone shape with the external edges oriented downward, as shown in FIG. 3. Obviously, it can also be provided that the external edges are oriented upward.

It is noted that, preferentially, the delivery unit 10 does not comprise any suction device or unit whatsoever to suck in the sterilizing mean above the tubular wrapping 20A.

In accordance with other embodiments, the delivery unit 10 also comprises a uniforming device 19 associated with the nozzle 11 in the proximity of the outlet end 17 of the sterile duct 14, and configured make the flow of sterile gas G inside the tubular wrapping 20A uniform, or homogenized. This prevents the creation of preferential routes that lead to a non-uniform dilution of the sterilizing mean S in the sterile gas G inside the tubular wrapping 20A.

According to some embodiments, the uniforming device is connected to the outlet end 17 of the sterile duct 14 (FIGS. 2 and 3); however, it is also possible to provide that it is integrated with the sterile duct 14, for example by providing a series of lateral through holes distributed over the entire circumference of the duct.

According to preferred embodiments, the delivery of the sterilizing mean S occurs continuously, in accordance with the feed of the film 20.

According to preferred embodiments, the delivery of the sterile gas G occurs intermittently, in accordance with the feed of the film 20 and/or with the delivery of the sterilizing mean S. In this way, the sterilizing mean S is momentarily removed from the bottom of the tubular wrapping 20A, so that a dose of product P can be delivered into it and, immediately afterward, the tubular wrapping 20 can be made to advance so as to dispose the dose of product just delivered downstream of the second welding means 52, and thus perform the transverse weld 22A to close a new sachet B.

It is noted that the delivery of the product P in the bottom of the tubular wrapping 20A causes the thrust of the sterilizing mean S upward, and therefore its exit from the tubular wrapping 20A.

In preferred embodiments, the delivery of the product P occurs intermittently, in accordance with the modes with which the transverse welds 23 are made. In other embodiments, the delivery of the product P occurs continuously.

Some embodiments described here also concern an aseptic machine 50 for packaging sachets B comprising at least one delivery unit 10 as described in the present invention.

The machine 50, schematically shown in FIG. 8, comprises a delivery unit 10 as described above, advantageously disposed so as to have the nozzles 11 oriented vertically with the outlet ends 15, 16, 17 oriented downward.

According to some embodiments, the machine 50 comprises a pressurizer 53 disposed above the delivery unit 10 and configured to feed a laminar flow L of air, in a vertical or substantially vertical direction and downward (FIG. 8).

This laminar flow L, which does not enter the tubular wrappings 20A due to the presence of the deflector elements 18, conveys the vapors of the sterilizing mean S downward, and along the external surface of the tubular wrappings 20A, thus creating a micro-environment around such tubular wrappings 20A which contains the sterilizing mean S, and therefore protects the tubular wrappings 20A (FIG. 8).

In this way, the excess vapors of the sterilizing mean S are exploited to the advantage of the functioning of the filling machine 50.

We wish to point out that, in this way, the aseptic machine 50, and more particularly its delivery unit 10, allow to effectively and reliably sterilize both the inside and also the outside of the tubular wrappings 20A.

Below the delivery unit 10, more preferably at the base of the machine 50, there is a suction unit 54 that sucks in the laminar flow L of air together with the conveyed vapors of the sterilizing mean S, in order to expel them outside the machine 50, in a known manner.

One example of the functioning of the machine 50 will be described in detail below. The following example is described purely by way of illustration and therefore is not to be considered as limiting.

Referring to FIGS. 1, 2, 3 and 8, during use, one or more films 20 of the material that will form the sachets B slides around at least one nozzle 11.

By means of the first welding means 51 (FIG. 1) the machine 50 makes longitudinal welds 21 which join the one or more films 20 forming a substantially tubular wrapping 20A that wraps around and contains the nozzle 11. Generally, the longitudinal welds 21 are made upstream of the outlet end 16 of the sterilant delivery duct 13 of the nozzle 11. By means of the second welding means 52 the machine 50 also makes transverse welds 22 which, by transversely closing the wrapping 20A, define the sachets B.

It is clear that the wrapping 20A advances along the nozzle 11 in accordance with the feed of the film 20. It is also clear that the longitudinal welds 21 are produced continuously in accordance with the advance of the film, in this way, the nozzle 11 is always wrapped and comprised in a wrapping 20A of film 20.

During use, the sterilant delivery duct 13 delivers a sterilizing mean S inside the wrapping 20A. At the same time, the sterile delivery duct 14 intermittently delivers a sterile gas G under pressure inside the wrapping 20A, downstream of the outlet end 16 of the sterilant delivery duct 13. In this way, a first zone is created in the wrapping 20A in which the advancing film 20 contacts the sterilizing mean S and is consequently sterilized.

Downstream of this first zone, a second zone is momentarily created which contains the sterile gas G under pressure.

The sterile gas G in the wrapping 20A serves to purge a corresponding volume of sterilizing mean S so as to be able to deliver a dose of product P to be packaged in the bottom of the tubular wrapping 20A. The delivery of the product P preferably occurs intermittently, in accordance with the delivery of sterile gas G, by means of the product delivery duct 12.

In addition, the delivery of the product P is carried out above the last transverse weld 22A made. Once the quantity of product P to be packaged has been delivered, another transverse weld 22 is made which closes the sachet B and which defines the new last transverse weld 22A.

During the production phase of the machine 50, a laminar flow L of air is continuously delivered vertically downward, by means of the pressurizer 53. The laminar flow L which passes through the delivery unit 10 is deflected by the deflector elements 18 so as not to enter inside the tubular wrappings 20A.

The laminar flow L conveys with it the excess vapors of the sterilizing mean S which come out of the tubular wrappings 20A and makes them lap the external surfaces of the tubular wrappings 20A (FIG. 8). A localized protective micro-environment is thus created which contains the sterilizing mean S.

The latter is conveyed along the entire delivery unit 10 until it reaches the suction unit 54 at the base of the machine 50, where the vapors of the sterilizing mean S and the air of the laminar flow L are sucked in and fed to the outside of the machine, in a known manner.

It is clear that modifications and/or additions of parts or steps may be made to the delivery unit 10, to the machine 50 and to the sterilization method as described heretofore, without departing from the field and scope of the present invention as defined by the claims.

In the following claims, the sole purpose of the references in brackets is to facilitate reading: they must not be considered as restrictive factors with regard to the field of protection claimed in the specific claims.

The invention claimed is:

1. A method to sterilize a tubular wrapping in a packaging machine during its normal functioning, said packaging machine comprising a delivery unit provided with at least one nozzle configured to feed a product to be packaged, a sterilizing mean and a sterile gas, said method comprising:

feeding a film of packaging material along the at least one nozzle of said delivery unit, making longitudinal welds which join the films forming the tubular wrapping around said at least one nozzle and containing the latter, the tubular wrapping being closed at its lower part by a transverse weld and open at its upper aperture;

feeding a sterilizing mean into said tubular wrapping using the at least one nozzle, the at least one nozzle comprising a sterilant delivery duct which has a respective outlet end and which is configured to deliver the sterilizing mean;

deflecting the sterilizing mean at exit from the tubular wrapping in a transverse direction with respect to the development axis of the at least one nozzle using a deflector disposed around the at least one nozzle and upstream of both the upper aperture of the tubular wrapping and of the outlet end of the sterilant delivery duct so as to remain outside the tubular wrapping;

making said sterilizing mean flow outside said tubular wrapping through said upper aperture, wherein the deflector is configured to protect the upper aperture from external agents and to interfere with the flow of said sterilizing mean exiting from said tubular wrapping to allow said sterilizing mean to flow outside of the tubular wrapping without being diluted by said external agents; and wherein the longitudinal welds are made upstream of the outlet end of the sterilant delivery duct and the transverse welds are made downstream of the at least one nozzle.

2. The method as in claim 1, further including conveying said sterilizing mean along said at least one nozzle and outside said tubular wrapping using a laminar flow.

3. The method as in claim 1, further including sucking in the gas and the sterilizing mean downstream of the delivery unit using a suction unit.

4. An aseptic machine for packaging sachets starting from a film of packaging material and configured to implement a sterilization method as in claim 1, wherein the machine comprises:

the delivery unit comprising the at least one nozzle around which the tubular wrapping is created open in its upper part which in turn comprises:

a product delivery duct which has an outlet end and is configured to deliver a product, and the outlet end of the sterilant delivery duct is configured to deliver the sterilizing mean, wherein the deflector element is disposed upstream of said outlet end of the sterilant delivery duct directly above the upper aperture of said tubular wrapping and outside the latter and protects the upper aperture from external agents, wherein said deflector element is further configured to interfere with the flow of said sterilizing mean which exits from said tubular wrapping to allow said sterilizing mean to flow outside of the tubular wrapping without being diluted by said external agents, and the machine further comprises first welding means to make, upstream of said outlet end of said sterilant delivery duct, longitudinal welds able to define at least one side of said sachets and further comprising second welding means to make, downstream of the at least one nozzle, transverse welds able to define transverse sides of said sachets so as to seal the latter; and wherein said outlet ends are enclosed, during use, by said tubular wrapping.

5. The aseptic machine as in claim 4, further comprising a suction unit disposed downstream of the delivery unit configured to suck in the laminar flow and the sterilizing mean.

6. The aseptic machine as in claim 4, wherein said deflector element is disposed upstream of said first welding means.

7. The aseptic machine as in claim 4, wherein said delivery unit also comprises a sterile delivery duct to deliver a sterile gas, and further comprising a uniforming device associated with said sterile delivery duct configured to make a flow of said sterile gas uniform inside the tubular wrapping.

8. The aseptic machine as in claim 4, further including a pressurizer disposed upstream of said delivery unit configured to feed a laminar flow of gas longitudinally to the development axis of the at least one nozzle, so as to convey vapors of the sterilizing mean toward said delivery unit.

9. The method as in claim 1, further including the step of feeding a laminar flow of gas along the at least one nozzle, in a same feed direction of as a film feed direction, and outside said tubular wrapping.

10. A delivery unit for an aseptic packaging machine for packaging sachets starting from a film of packaging material comprising: at least one nozzle that comprises a product delivery duct which has an outlet end and is configured to deliver a product, and a sterilant delivery duct which has a respective outlet end configured to deliver a sterilizing mean, and around which both these outlet ends there is created a tubular wrapping open in its upper part that encloses, during use, the outlet end of the product delivery duct and the outlet end of the sterilant delivery duct, and the delivery unit further comprising one deflector element disposed around the nozzle and upstream of said outlet end of the sterilant delivery duct, directly above an upper aperture of said tubular wrapping and outside the latter and protects the upper aperture from external agents, wherein the deflector element is configured to interfere with the flow of said sterilizing mean which exits from said tubular wrapping to allow said sterilizing mean to flow outside of the tubular wrapping without being diluted by said external agents.

11. The delivery unit as in claim 10, wherein the deflector element extends transversely from a development axis of the at least one nozzle.

12. The delivery unit as in claim 10 further comprising a sterile delivery duct to deliver a sterile gas, and further comprising a uniforming device associated with said sterile delivery duct configured to make a flow of said sterile gas uniform inside the tubular wrapping.

* * * * *